US010058126B2

(12) United States Patent
Chen

(10) Patent No.: US 10,058,126 B2
(45) Date of Patent: Aug. 28, 2018

(54) ELECTRONIC CIGARETTE

(71) Applicant: SHENZHEN SMOORE TECHNOLOGY LIMITED, Shenzhen (CN)

(72) Inventor: Zhiping Chen, Shenzhen (CN)

(73) Assignee: Shenzhen Smoore Technology Limited, Shenzhen, Guangdong (CN)

( * ) Notice: Subject to any disclaimer, the term of this patent is extended or adjusted under 35 U.S.C. 154(b) by 0 days.

(21) Appl. No.: 15/118,425

(22) PCT Filed: May 26, 2014

(86) PCT No.: PCT/CN2014/078427

§ 371 (c)(1),
(2) Date: Aug. 11, 2016

(87) PCT Pub. No.: WO2015/180018

PCT Pub. Date: Dec. 3, 2015

(65) Prior Publication Data

US 2017/0164655 A1 Jun. 15, 2017

(51) Int. Cl.

| | |
|---|---|
| ***A24F 13/04*** | (2006.01) |
| ***A24F 47/00*** | (2006.01) |
| ***H05B 1/02*** | (2006.01) |

(52) U.S. Cl.

CPC ..... *A24F 47/008* (2013.01); *H05B 1/0244* (2013.01); *H05B 2203/021* (2013.01)

(58) Field of Classification Search

CPC ..... A24F 15/02; A24F 47/008; G01F 23/00; A61M 16/145; A61M 16/109

(Continued)

(56) References Cited

U.S. PATENT DOCUMENTS 8,528,569 B1 * 9/2013 Newton ..... A61M 15/06 128/202.21
9,185,937 B2 * 11/2015 Liu ..... A24F 47/008

(Continued)

FOREIGN PATENT DOCUMENTS

CN 102920028 A 2/2013
CN 203327953 U 12/2013

(Continued)

*Primary Examiner* — Hien Vu

(74) *Attorney, Agent, or Firm* — Weiss & Moy, P.C.; Jeffrey D. Moy

(57) ABSTRACT

An electronic cigarette includes a cartridge (12) and an atomizing assembly (13); the atomizing assembly (13) is fixed in the cartridge (12); the atomizing assembly (13) comprises a reservoir (105), a liquid guiding medium (106) and a heating element (107); the reservoir (105) has a liquid storage cavity (108) storing tobacco liquid and a liquid outlet (109); the liquid outlet (109) communicates with the liquid storage cavity (108); the liquid guide medium (106) is porous liquid guiding material, and is connected to the liquid outlet (109); the heating element (107) is fixed in the cartridge (12), and a gap exists between the heating element (107) and the liquid guide medium (106); the liquid guide medium (106) guides the tobacco liquid out of the reservoir (105) via the liquid outlet (109) and stores the tobacco liquid; the gap exists between the heating element (107) and the liquid guide medium (106) so that the heating element (107) heats the liquid guide medium (106) without directly contacting the liquid guide medium (106), thus preventing the heating element (107) from polluting the atomized tobacco liquid, and being helpful to the health of a user.

7 Claims, 11 Drawing Sheets

(58) Field of Classification Search
USPC ..... 131/328, 329, 194
See application file for complete search history.

(56) References Cited

U.S. PATENT DOCUMENTS

| | | | | |
|---|---|---|---|---|
| 9,254,007 | B2 * | 2/2016 | Liu | A24F 47/008 |
| 9,364,025 | B2 * | 6/2016 | Liu | A24F 47/008 |
| 9,364,800 | B2 * | 6/2016 | Dubief | A24F 47/008 |
| 9,427,022 | B2 * | 8/2016 | Levin | A24F 47/008 |

FOREIGN PATENT DOCUMENTS

| | | | |
|---|---|---|---|
| CN | 203523810 | U | 4/2014 |
| WO | 2014012894 | A1 | 1/2014 |

* cited by examiner

ELECTRONIC CIGARETTE

FIELD OF THE INVENTION

The present disclosure relates to a field of electronic atomizers, and more particularly relates to an electronic cigarette.

BACKGROUND OF THE INVENTION

Electronic cigarette is also known as a virtual cigarette or an electronic atomizer. As a replacement for cigarettes, the electronic cigarette is usually used for smoking cessation. The appearance and taste of the electronic cigarette are similar to that of the conventional cigarette, while it does not contain tar, suspended particles and other harmful ingredients in the conventional cigarette.

The electronic cigarette is mainly composed of an atomizer and a battery assembly. As a core device of the electronic cigarette to generate atomizing gas, the quality and taste of the smoke are dependent on the atomization effect of the atomizer. A conventional heating element of the atomizer is a spiral heating wire wrapped around a positioning shaft. When the heating wire is powered by the battery assembly, the liquid stored in the storage medium will be absorbed by the positioning shaft, and it is then atomized by the heat of the heating wire. However, the heating wire is normally a resistance wire, such as a nickel-chromium alloy resistance wire. When this type of resistance wire is in direct contact with the liquid, a small amount of metal elements (such as: chromium) or other trace elements (such as phosphorus, carbon, sulfur, etc.) will be generated during the atomizing process, such that the user may inhale cadmium, sulfur and other harmful substances during use, which is harmful to the health of the user.

SUMMARY OF THE INVENTION

Accordingly, it is necessary to provide an electronic cigarette which is conducive to the health of users.

An electronic cigarette includes: a cartridge; and an atomizing assembly fixed in the cartridge, the atomizing assembly including: a reservoir, the reservoir having a liquid storage chamber for storing liquid and a liquid outlet in fluid communication with the liquid storage chamber; a liquid guiding medium made of porous liquid guiding material and connected to the liquid outlet; and a heating element fixed in the cartridge, wherein the heating element and the liquid guiding medium form a gap therebetween.

In one embodiment, the liquid reservoir has a tubular shape and defines an airflow channel, the liquid reservoir comprises opposed first and second ends, the liquid outlet is defined at the second end, the airflow channel has a first opening formed at the first end and a second opening formed at the second end.

In one embodiment, the liquid guiding medium is partially received in the airflow channel via the second opening.

In one embodiment, the heating element has a heating chamber, the liquid guiding medium has an insertion end and a heated end opposing to the insertion end, the insertion end is located inside the airflow channel, the heated end is located in the heating chamber.

In one embodiment, the insertion end has a stepped shape, the liquid outlet is defined at inner sidewalls of the second end and the airflow channel, the insertion end is connected to the liquid outlet.

In one embodiment, the liquid outlet has an annular shape and surrounds the airflow channel, the liquid guiding medium has an annular shape matching the liquid outlet, and the liquid guiding medium is received in the liquid outlet.

In one embodiment, the heating element comprises a reflector and a heating tube fixed to the reflector, the heating tube and the liquid guiding medium forms a gap therebetween.

In one embodiment, the cartridge includes opposed first and second connecting ends, the electronic cigarette further includes a mouthpiece and a power assembly, the mouthpiece is connected to the first connecting end, the second connecting end is connected to a first connection structure, the power assembly is connected to a second connection structure, the second connection structure is connected to the first connection structure, the heating element is electrically coupled to the power assembly via the first connection structure and the second connection structure.

In one embodiment, the first connection structure includes: a threaded sleeve that is conductive and fixed to the second connecting end; and a first electrode tube received in the threaded sleeve and insulated from threaded sleeve.

In one embodiment, the second connection structure includes: a threaded post that is conductive and fixed to the power assembly, wherein the threaded post is located inside the threaded sleeve and is threadedly engaged with the threaded sleeve, the threaded post defines a shaft hole and has a rim portion fixed in the shaft hole; a second electrode tube received in the shaft hole and electrically coupled to the first electrode tube; and an insulating sleeve disposed between the rim portion and the second electrode tube, thereby insulating the threaded post from the second electrode tube.

In one embodiment, the first connection structure includes: a threaded post that is conductive and fixed to the second connecting end, wherein the threaded post comprises a first cylinder and a second cylinder connected to the first cylinder, the first cylinder is provided with first and second spaced apart flanges on an outer side thereof, the first flange and the second flange form a first annular groove therebetween; a first electrode tube received in the threaded post; a first insulating sleeve disposed between the threaded post and the first electrode tube, thereby insulating the threaded post from the first electrode tube; and a resilient element disposed between the threaded post and an inner sidewall of the cartridge, wherein the resilient element comprises a ring and a bending portion connected to the ring, the ring is received in the first annular groove, the bending portion is located between the inner sidewall and the threaded post.

In one embodiment, the second connection structure includes: a threaded sleeve that is conductive and fixed to the power assembly, the threaded sleeve comprises a threaded portion and a rim portion connected to the threaded portion, the threaded portion is connected to the second cylinder; a second electrode tube received in the threaded sleeve and connected to the first electrode tube; and a second insulating sleeve disposed between the rim portion and the second electrode tube, thus insulating the threaded post from the second electrode tube.

In one embodiment, the ring has an inclined surface on a side thereof adjacent to the cartridge for guiding installation.

In one embodiment, the ring is embedded in the first annular groove and is firmly attached to partial sidewall of the threaded post, such that the cartridge and the threaded post are firmly engaged.

In one embodiment, the first insulating sleeve includes an annular insulating substrate and an insulating tube located on the insulating substrate, partial inner sidewall of the first cylinder is firmly attached to partial outer sidewall of the insulating tube.

In one embodiment, the reservoir includes a liquid storage space and a liquid guiding tube, the liquid storage space has opposed first and second ends, and the liquid storage chamber for storing liquid, the liquid guiding tube extends out of the second end and is connected to the liquid guiding medium.

In one embodiment, the liquid reservoir defines an airflow channel extending through the liquid storage space and the liquid guiding tube, the liquid outlet is defined on an inner sidewall of the airflow channel, and the liquid outlet is in fluid communication with the liquid storage chamber.

In the aforementioned electronic cigarette, the liquid guiding medium can guide and restore the liquid from the reservoir. Since the gap is formed between the heating element and the liquid guiding medium, the heating element does not have to be in direct contact with the liquid guiding medium during heating the liquid guiding medium, thus avoiding contamination to the atomized liquid by the heating element, which is conducive to the health of user.

DETAILED DESCRIPTION OF THE EMBODIMENTS

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
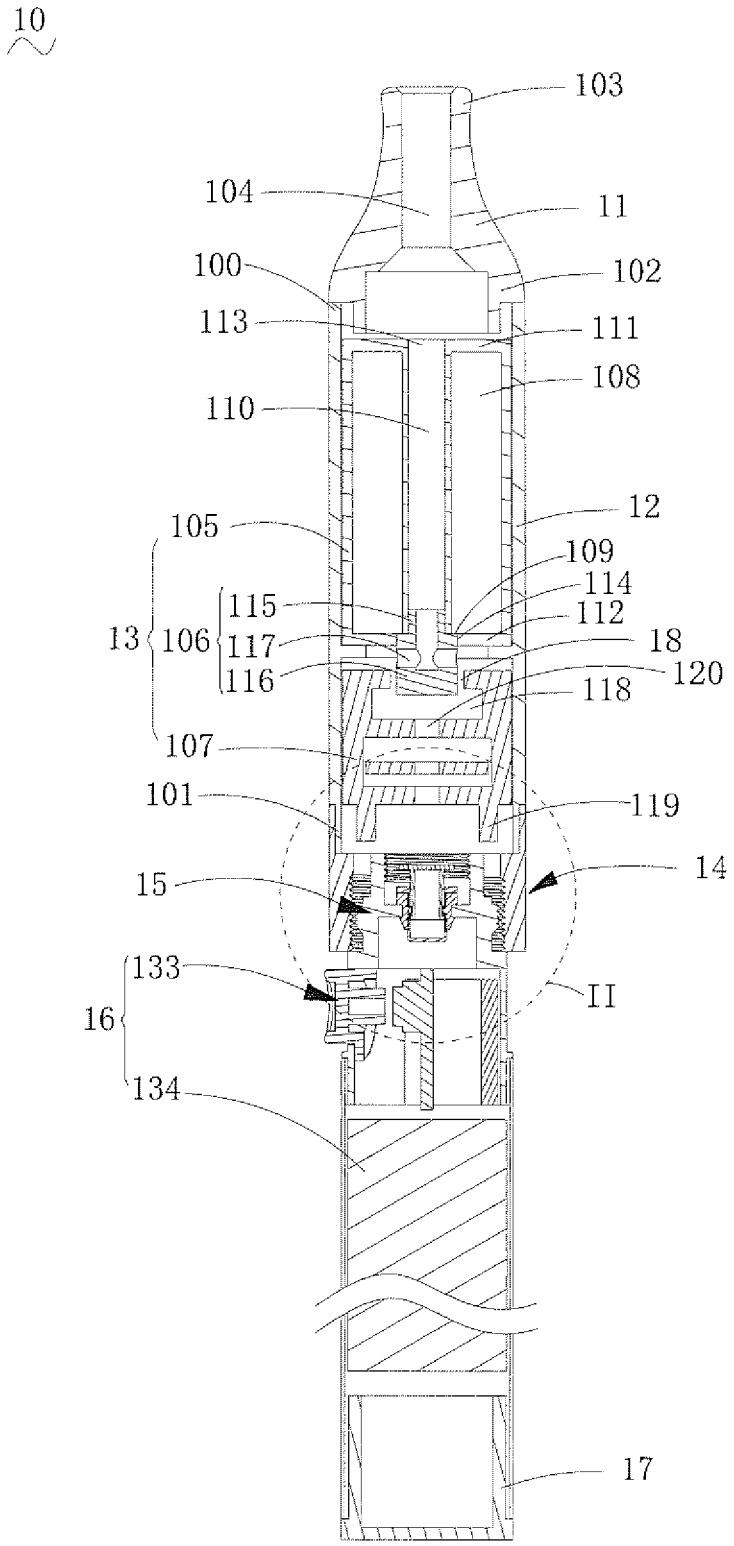
FIG. 1 is a cross-sectional view of an electronic cigarette according to a first embodiment.
Figure 2:
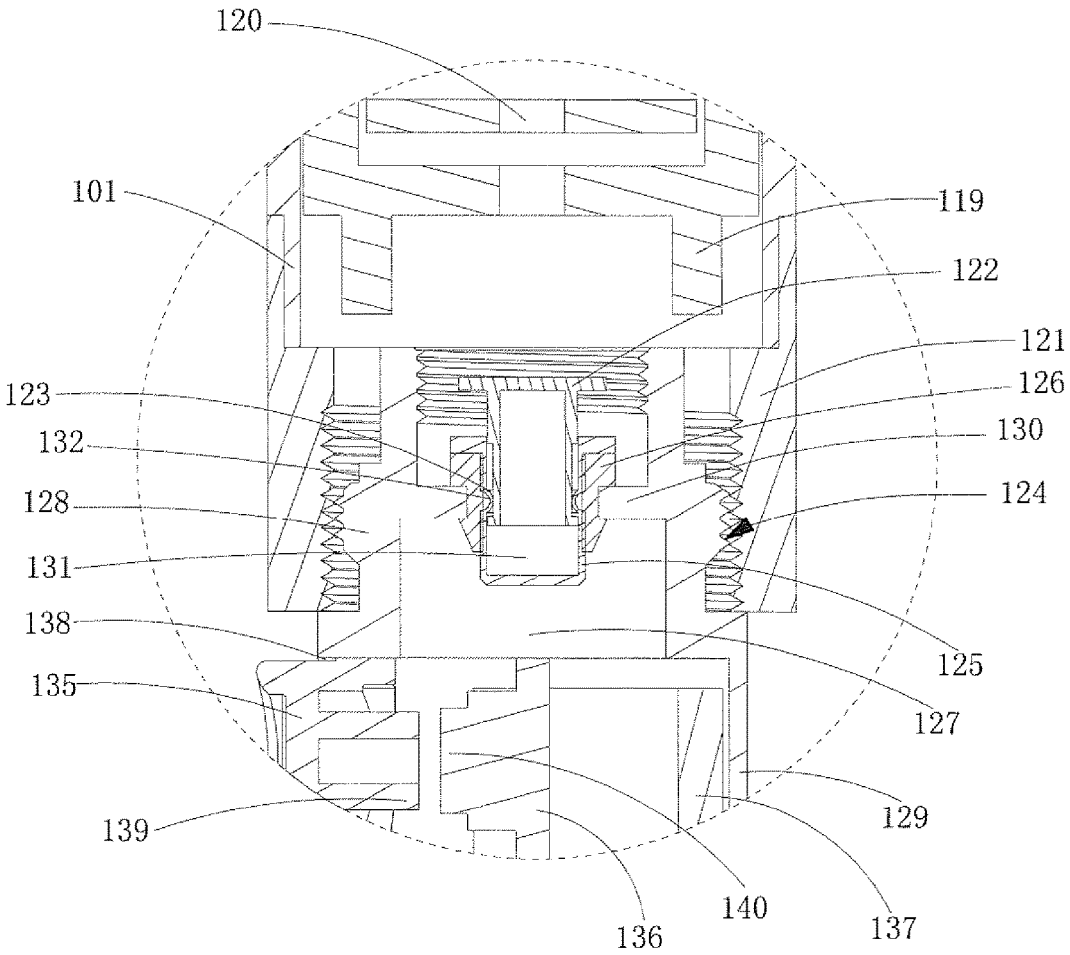
FIG. 2 is an enlarged view of portion II of the electronic cigarette of FIG. 1.

Referring to FIG. 1 and FIG. 2, an electronic cigarette 10 according to a first embodiment includes a mouthpiece 11, a cartridge 12, an atomizing assembly 13, a first connection structure 14, a second connection structure 15, a power assembly 16, and an end cap 17, which are subsequently disposed. The electronic cigarette 10 according to the illustrated embodiment has a substantially cylindrical shape. In alternative embodiments, the electronic cigarette 10 may have other shapes such as prism.

The cartridge 12 includes a first connecting end 100 and a second connecting end 101 opposite to the first connecting end 100. The mouthpiece 11 is disposed on the first connecting end 100.

The mouthpiece 11 is substantially funnel-shaped. The mouthpiece 11 has a bigger end 102 connected to the first connecting end 100, and it has a smaller end 103 for user to suck. The funnel-shaped mouthpiece 11 is convenient for people to use. The mouthpiece 11 can be made of plastic materials, such as silica gel. The mouthpiece 11 has a vent 104 that allows air to pass through. The first connection structure 14 is connected to the second connecting end 101.

The atomizing assembly 13 is fixed in the cartridge 12. The atomizing assembly 13 includes a reservoir 105, a liquid guiding medium 106, and a heating element 107.

The reservoir 105 has a liquid storage chamber 108 for storing liquid and a liquid outlet 109. The liquid outlet 109 is in fluid communication with the liquid storage chamber 108 to allow the liquid to be drawn through the liquid outlet 109. The reservoir 105 can be made of glass or high temperature plastics, such as PPS, PPA or LCP, PC, etc. In the illustrated embodiment, the reservoir 105 has a substantially tubular shape. In alternative embodiments, the reservoir 105 may have other shapes such as prism.

The reservoir 105 defines an airflow channel 110 therein. The reservoir 105 includes a first end 111 and a second end 112 opposite to the first end 111. The liquid outlet 109 is defined at inner surfaces of the second end 112 and the airflow channel 110, i.e. the liquid outlet 109 is located at the junction between the inner surfaces of the second end 112 and the airflow channel 110. The airflow channel 110 has a first opening 113 formed at the first end 111 and a second opening 114 formed at the second end 112. The first opening 113 is positioned closer to the mouthpiece 11 than the second opening 114.

The liquid guiding medium 106 is made of porous liquid guiding materials and connected to the liquid outlet 109. In the illustrated embodiment, the liquid guiding medium 106 is made of porous ceramic, preferably porous ceramic material with high thermal conductivity. The liquid guiding medium 106 is partially received in the airflow channel 110 via the second opening 114. Specifically, the liquid guiding medium 106 includes an insertion end 115 and a heated end 116 opposing to the insertion end 115. The insertion end 115 is located inside the airflow channel 110, the insertion end 115 has a stepped shape and is connected to the liquid outlet 109, such that the liquid from the reservoir 105 can be guided by the insertion end 115 to the liquid guiding medium 106 through the liquid outlet 109. The liquid guiding medium 106 defines a T-shaped aperture 117 in fluid communication with the airflow channel 110. It should be understood that, in alternative embodiment, the liquid guiding medium 106 can be made of refractory porous glass, porous graphite, porous fibers, and other porous materials. Because the reservoir 105 uses high temperature plastics or glass as a liquid storage medium instead of fire cotton, and uses porous ceramic material as the liquid guiding medium instead of high silica fiber rope, the problem of producing bacteria due to the long term contact between the fire cotton/high silica fiber rope and the liquid can be avoided. In addition, the fire cotton and the high silica fiber rope tends to absorb impurities during use of the electronic cigarette, which results in unsmooth of the liquid guiding. The electronic cigarette 10 according to the present embodiment can overcome this deficiency and achieve a smooth liquid guiding and is healthy to use.

The heating element 107 is fixed in the cartridge 12, and a gap 18 is formed between the heating element 107 and the liquid guiding medium 106. The heating element 107 can heat the liquid guiding medium 106 in a non-contact way. In the illustrated embodiment, the heating element 107 is an electronic pulse heating device and has a heating chamber 118 and an electrode portion 119. The heating chamber 118 and the electrode portion 119 are located at opposite ends o the heating element 107. The heated end 116 of the liquid guiding medium 106 is received inside the heating chamber 118. The electrode portion 119 is electrically coupled to the first connection structure 14. The heating element 107 defines a through hole 120 therein to allow the airflow to pass through. The T-shaped aperture 117 is in fluid communication with the through hole 120 via the heating chamber 118. During assembly of the conventional electronic cigarette, due to individual skills of each worker, the number of turns of the heat wire and the space between each turn is different, which causes the final taste of each electronic cigarette is different. However, in the illustrated embodiment, since no heating wire is used, the aforementioned problem is overcome.

In the illustrated embodiment, the first connection structure 14 includes a conductive threaded sleeve 121 and a first electrode tube 122. The threaded sleeve 121 is fixed to the second connecting end 101 of the cartridge 12. The first electrode tube 122 is received in the threaded sleeve 121 and is insulated from the threaded sleeve 121. In the illustrated embodiment, an annular latching groove 123 is provided on an outer sidewall of the first electrode tube 122. It should be understood that, the first electrode tube 122 can be fixed to an inner sidewall of the second connecting end 101 by some fastening elements (not shown), such as fixing rod or fixing block, etc. The electrode of the electrode portion 119 is electrically coupled to the threaded sleeve 121 and the first electrode tube 122, respectively. In the illustrated embodiment, the threaded sleeve 121 is made of gold-plated brass, which has a good conductivity with excellent plasticity for easy shaping. In alternative embodiment, the threaded sleeve 121 can be made of other conductive materials. The first electrode tube 122 and the threaded sleeve 121 can be made of the same or different materials.

The second connection structure 15 is connected to the power assembly 16 and is connected to the first connection structure 14. The heating element 107 is electrically coupled to the power assembly 16 via the first connection structure 14 and the second connection structure 15.

In the illustrated embodiment, the second connection structure 15 includes a conductive threaded post 124, a second electrode tube 125, and an insulating sleeve 126. The threaded post 124 is fixed to the power assembly 16, and the threaded post 124 is located inside the threaded sleeve 121 and is threadedly engaged with the threaded sleeve 121. The threaded post 124 defines a shaft hole 127 therein and includes a first cylinder 128 and a second cylinder 129 connected to the first cylinder 128. The shaft hole 127 extends through the first cylinder 128 and the second cylinder 129. The first cylinder 128 is provided with a rim portion 130 in the shaft hole 127. The maximum diameter of the first cylinder 128 is greater than that of the second cylinder 129. The second electrode tube 125 is received in a part of the shaft hole in the first cylinder 128 and is connected to the first electrode tube 122. In the illustrated embodiment, the second electrode tube 125 defines an inserting hole 131 and forms an annular rib 132 inside the inserting hole 131. The annular rib 132 can be engaged in the latching groove 123, such connection method as that can ensure a better electrical connection between the first electrode tube 122 and the second electrode tube 125 and improve the structural stability. Both of the first electrode tube 122 and the second electrode tube 125 defines a vent (not shown) along an axis of the electronic cigarette 10. In the illustrated embodiment, the threaded post 124 is made of the same materials as that of the threaded sleeve 121, e.g. gold-plated brass. In alternative embodiments, the threaded post 124 can be made of other conductive materials. The second electrode tube 125 and the threaded post 124 can be made of the same or different materials.

The insulating sleeve 126 is disposed between the rim portion 130 and the second electrode tube 125, such that the threaded post 124 is insulated from the second electrode tube 125, and a firmly engagement is formed between the threaded post 124 and the second electrode tube 125. A structural stability of the threaded post 124 and the second electrode tube 125 is increased accordingly. The insulating sleeve 126 can be made of insulation materials, such as silicone, rubber, etc.

The power assembly 16 includes a switch 133 and a battery 134. The switch 133 is disposed on the shaft hole of the second cylinder 129. The switch 133 includes a button 135, a contact pad 136, and a conducting plate 137. The second cylinder 129 defines a button hole 138 in communication with the shaft hole 127, the button 135 can be exposed from the button hole 138, thus facilitating pressing by the user. The button 135 has a first contacting point 139 corresponding to the contact pad 136, and the first contacting point 139 is electrically coupled to the threaded post 124. The contact pad 136 is electrically coupled to one electrode of the battery 134. The contact pad 136 has a second contacting point 140 corresponding to the first contacting point 139. When the button 135 is pressed by external force, the first contacting point 139 is in contact with the second contacting point 140, such that the threaded post 124 is in electrical connection with the electrode of the battery 134. When the external force applied to the button 135 is removed, the button 135 can restore to its initial position by a resilient element (not shown) of the switch 133, such that the first contacting point 139 is disengaged from the second contacting point 140.

The conducting plate 137 is coupled to the second electrode tube 125 and the other electrode of the battery 134, thus achieving an electrical connection between the first electrode tube 122 and the other electrode of the battery 134. In the illustrated embodiment, the battery 134 is a battery integrated with controlled IC.

The end cap 17 and the second connection structure 15 are positioned on opposed ends of the power assembly 16. The end cap 17 defines an air intake (not shown) to allow the air to be drawn into the electronic cigarette 10. Entering from the air intake of the end cap 17, the air flow can pass through the shaft hole 127 of the threaded post 124, the vent of the first electrode tube 122 and the second electrode tube 125, the through hole 120 of the heating element, then enter the T-shaped aperture 117. The airflow can carry the atomized liquid to pass through the airflow channel 110 and flow out from the vent 104 of the mouthpiece 11, thus it can be inhaled by the user.

In the aforementioned electronic cigarette 10, the liquid guiding medium 106 can guide and restore the liquid from the reservoir 105. Since the gap 18 is formed between the heating element 107 and the liquid guiding medium 106, the heating element does not have to be in direct contact with the liquid guiding medium 106 during heating the liquid guiding medium 106, thus avoiding contamination to the atomized liquid by the heating element 107, which is conducive to the health of user.

Figure 3:
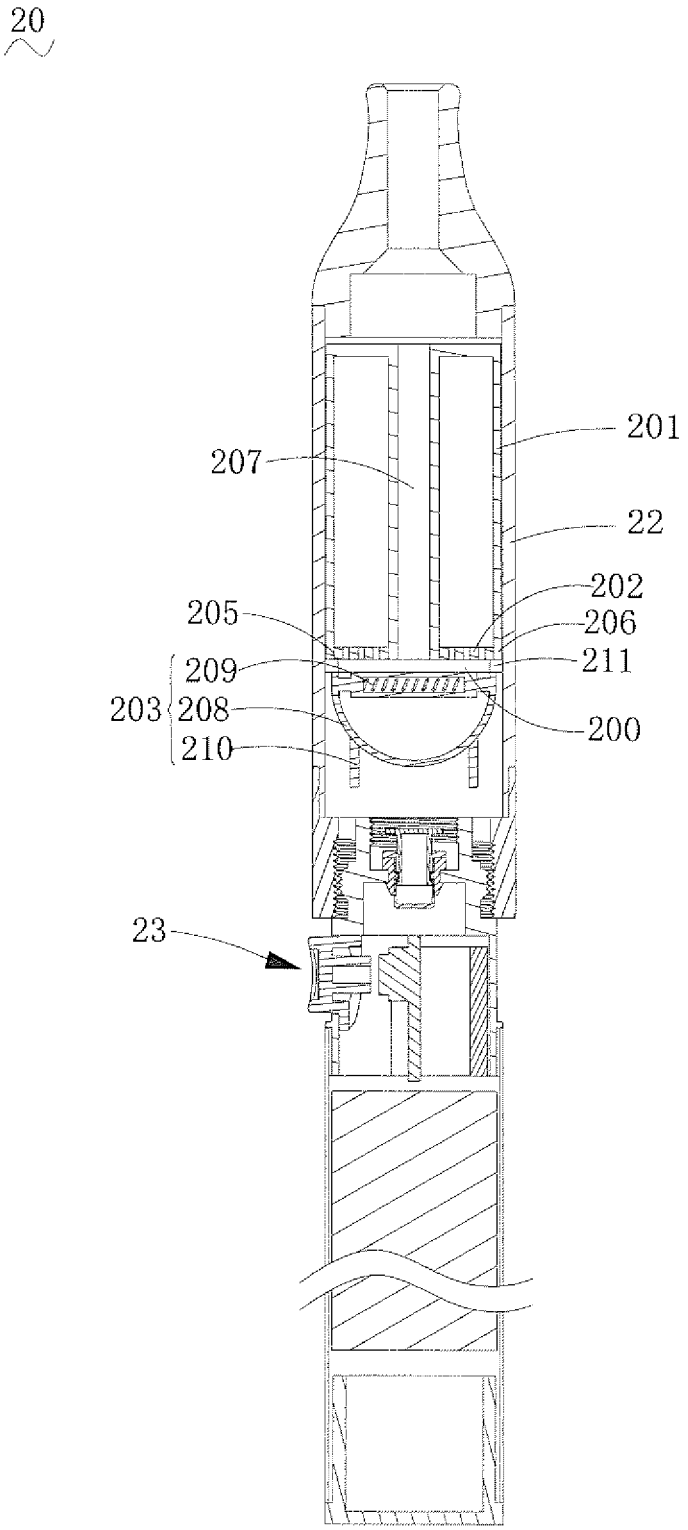
FIG. 3 is a cross-sectional view of an electronic cigarette according to a second embodiment.

Referring to FIG. 3, an electronic cigarette 20 is provided according to the second embodiment. The electronic cigarette 20 has a structure similar to that of the electronic cigarette 10 of the first embodiment, and it differs from electronic cigarette 10 in that, the reservoir 201, the liquid guiding medium 202, and the heating element 203 of the second embodiment are different from the first embodiment.

The liquid outlet 205 of the reservoir 201 is defined on the second end 206 of the reservoir 201, and the liquid outlet 205 has an annular shape surrounding the airflow channel 207. The liquid guiding medium 202 has an annular shape matching the liquid outlet 205, and the liquid guiding medium 202 is received in the liquid outlet 205.

The heating element 203 includes a reflector 208, a heating tube 209, and an electrode portion 210. The heating tube 209 and the electrode portion 210 are fixed to opposing sides of the reflector 208, and a gap 200 is formed between the heating tube 209 and the liquid guiding medium 202.

The reflector 208 is shaped as a spherical crown, which can radiate the heat generated by the heating tube 209 towards the liquid guiding medium 202. The reflector 208 is fixed to a rim 211 formed on the inner sidewall of the cartridge 22. The rim 211 is provided with a vent (not shown), the airflow can flow from the gap between the reflector 208 and the cartridge 22 into the gap 200 between the heating tube 209 and the liquid guiding medium 202 via the vent, such that the atomized liquid can be brought into the airflow channel 207 via the airflow. In alternative embodiments, the reflector 208 can have other shapes, as long as it can radiate the heat generated by the heating tube 209 towards the liquid guiding medium 202. In the illustrated embodiment, since the reflector 208 can focus the heat to the liquid guiding medium 202, the utilization of heat is improved. The connection type between the electrode portion 210 and the power assembly 23 is similar to that between the electrode portion 119 and the power assembly 16 of the first embodiment, which will not be described in further details.

In the illustrated embodiment, the heating tube 209 is an infrared heating tube. In alternative embodiments, the heating tube can be a photoelectric heating tube and other heating tube.

Figure 4:
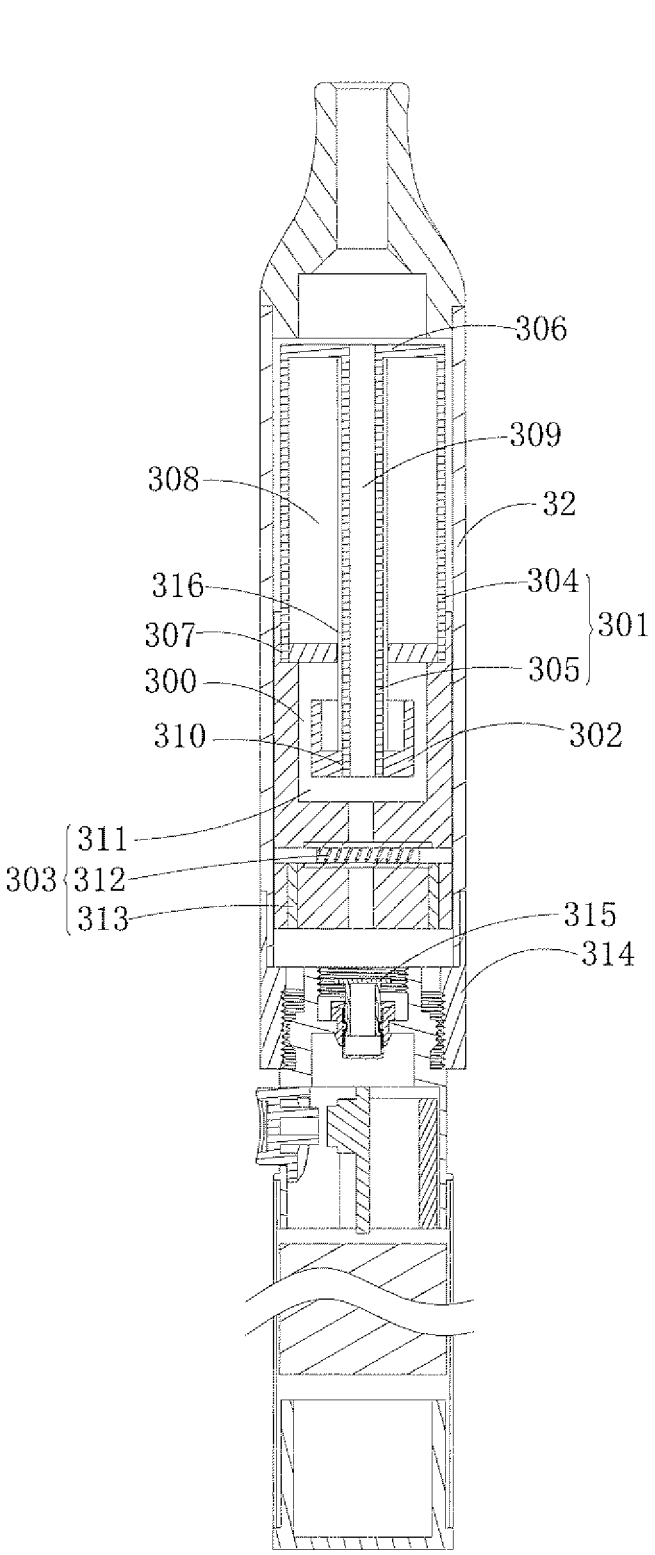
FIG. 4 is a cross-sectional view of an electronic cigarette according to a third embodiment.

Referring to FIG. 4, an electronic cigarette 30 is provided according to the third embodiment. The electronic cigarette 30 has a structure similar to that of the electronic cigarette 10 of the first embodiment, and it differs from electronic cigarette 10 in that, the reservoir 301, the liquid guiding medium 302, and the heating element 303 of the third embodiment are different from the first embodiment.

The reservoir 301 has a liquid storage space 304 and a liquid guiding tube 305. The liquid storage space 304 has a first end 306, a second end 307 opposite to the first end 306, and a liquid storage chamber 308 for storing liquid. The liquid guiding tube 305 extends out of the second end 307. The reservoir 301 defines an airflow channel 309, which extends through the liquid storage space 304 and the liquid guiding tube 305. The airflow channel 309 defines a liquid outlet 316 on an inner sidewall thereof, which is in fluid communication with the liquid storage chamber 308.

The liquid guiding medium 302 has a substantially columnar shape. The liquid guiding medium 302 defines a middle through hole 310 therein, and one end of the liquid guiding tube 305 is fixed inside the middle through hole 310.

In the illustrated embodiment, the heating element 303 is a microwave heating device. The heating element 303 is fixed inside the cartridge 32 and is connected to the reservoir 301. The heating element 303 has a heating chamber 311, a coil 312, and an electrode portion 313. The heating chamber 311 and the electrode portion 313 are located on opposing sides of the coil 312. One electrode of the electrode portion 313 is electrically coupled to the threaded sleeve 314, and the other electrode of the electrode portion 313 is electrically coupled to the first electrode tube 315.

The liquid guiding medium 302 and the liquid guiding tube 305 is received in the heating chamber 311, and a gap 300 is formed between the liquid guiding medium 302 and the heating element 303. The heating element 303 is connected to the reservoir 301, thus the heating chamber 311 can be well surrounded with less heat loss, and the liquid guiding medium 302 can absorb more heat to improve the efficiency of the electric heat and atomizing effect. In addition, the liquid guiding medium 302 is received in the heating chamber 311 as a whole, such that the whole liquid guiding medium 302 can absorb heat directly, thus improving the atomizing effect.

Figure 5:
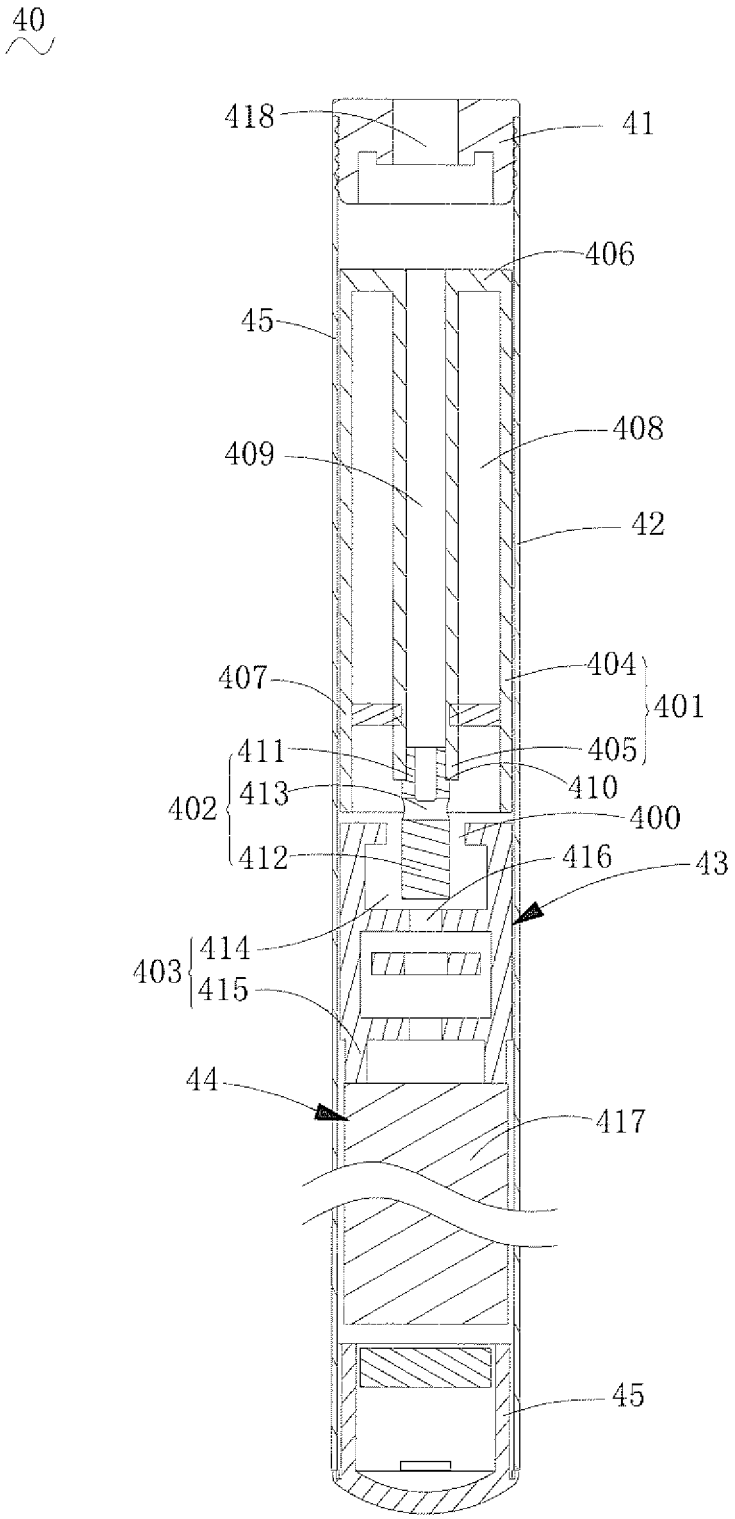
FIG. 5 is a cross-sectional view of an electronic cigarette according to a fourth embodiment.

Referring to FIG. 5, an electronic cigarette 40 is provided according to the fourth embodiment. The electronic cigarette 40 includes a mouthpiece 41, a cartridge 42, an atomizing assembly 43, a power assembly 44, and an end cap 45, which are subsequently disposed. In the illustrated embodiment, a tube body of the cartridge 42 and a tube body of the power assembly 44 are integrally formed, thus forming a housing 45 of the electronic cigarette. The housing 45 is substantially an elongated hollow cylinder. The mouthpiece 41 and the end cap 45 are located at opposing ends of the housing 45.

The atomizing assembly 43 is fixed in the cartridge 42. The atomizing assembly 43 includes a reservoir 401, a liquid guiding medium 402, and a heating element 403.

The reservoir 401 has a liquid storage space 404 and a liquid guiding tube 405. The liquid storage space 404 has a first end 406, a second end 407 opposite to the first end 406, and a liquid storage chamber 408 for storing liquid. The liquid guiding tube 405 extends out of the second end 407 and is connected to the liquid guiding medium 402. The reservoir 401 defines an airflow channel 409, which extends through the liquid storage space 404 and the liquid guiding tube 405. The reservoir 401 can be made of glass or high temperature plastics, such as PPS, PPA or LCP, PC, etc. In the illustrated embodiment, the liquid storage space 404 and the liquid guiding tube 405 have a substantially tubular shape. In alternative embodiments, the liquid storage space 404 and the liquid guiding tube 405 may have other shapes such as prism.

The airflow channel 409 defines a liquid outlet 410 on an inner sidewall thereof, which is in fluid communication with the liquid storage chamber 408.

The liquid guiding medium 402 is made of porous liquid guiding materials and connected to liquid guiding tube 405, so as to be connected to the liquid outlet 410. In the illustrated embodiment, the liquid guiding medium 402 is made of porous ceramic, preferably porous ceramic material with high thermal conductivity. The liquid guiding medium 402 includes an insertion end 411 and a heated end 412 opposing to the insertion end 411. The insertion end 411 is located inside the airflow channel 409, the insertion end 411 has a stepped shape and is connected to the liquid outlet 410, such that the liquid from the reservoir 401 can be guided by the insertion end 411 to the liquid guiding medium 402 through the liquid outlet 410. The liquid guiding medium 402 defines a T-shaped aperture 413 in fluid communication with the airflow channel 409. It should be understood that, in alternative embodiment, the liquid guiding medium 402 can be made of refractory porous glass, porous graphite, porous fibers, and other porous materials.

The heating element 403 is fixed inside the cartridge 42, and a gap 400 is formed between the heating element 403 and the liquid guiding medium 402. In the illustrated embodiment, the heating element 403 is an electronic pulse heating device, which includes a heating chamber 414 and an electrode portion 415. The heating chamber 414 and the electrode portion 415 are located at opposing ends of the heating element 403. The liquid guiding medium 402 has a heated end 412 located in the heating chamber 414. The heating element 403 defines a through hole 416 therein for allowing airflow to pass through. The T-shaped aperture 413 is in fluid communication with through hole 416 via the heating chamber 414.

The power assembly 44 includes a battery 417. In the illustrated embodiment, the battery 417 is a battery integrated with controlled IC. One electrode of the electrode portion 415 is coupled to one electrode of the battery 417, and the other electrode of the electrode portion 415 is coupled to the other electrode of the battery 417.

The end cap 45 defines an air intake (not shown) to allow the air to be drawn into the electronic cigarette 40. Entering from the air intake of the end cap 45, the airflow can pass through the gap of the power assembly 44 and the through hole 416 of the heating element 403, then enter the T-shaped aperture 117. The airflow can carry the atomized liquid to flow out from the vent 418 of the mouthpiece 41, thus it can be inhaled by the user.

The electronic cigarette 40 according the present embodiment omits the connection structure between the cartridge and the power assembly, thus simplifying the structure and reducing the cost.

Figure 6:
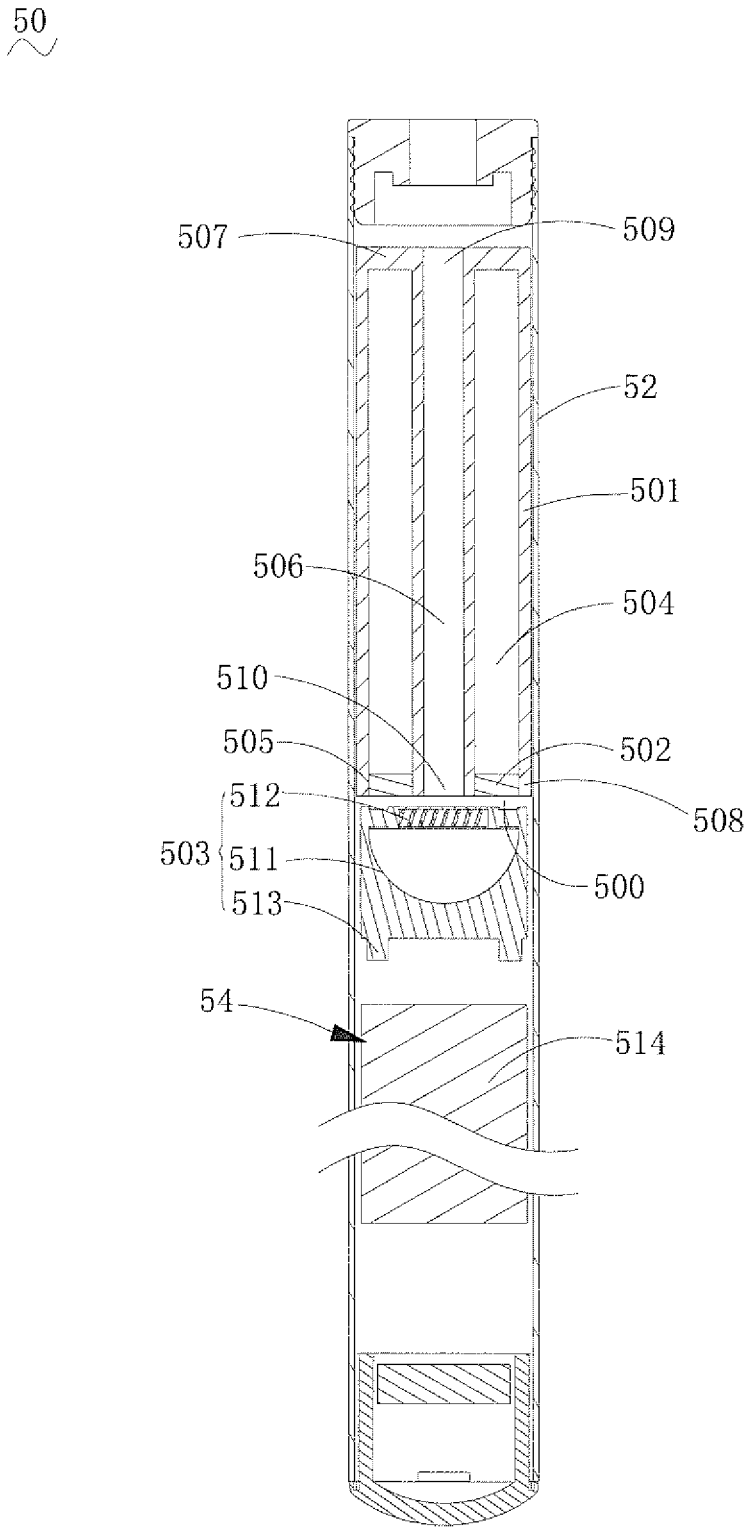
FIG. 6 is a cross-sectional view of an electronic cigarette according to a fifth embodiment.

Referring to FIG. 6, an electronic cigarette 50 is provided according to the fifth embodiment. The electronic cigarette 50 has a structure similar to that of the electronic cigarette 40 of the fourth embodiment, and it differs from electronic cigarette 40 in that, the reservoir 501, the liquid guiding medium 502, and the heating element 503 of the fifth embodiment are different from the fourth embodiment.

The reservoir 501 has a liquid storage chamber 504 for storing liquid and a liquid outlet 505. The liquid outlet 505 is in fluid communication with the liquid storage chamber 504 to allow the liquid to be drawn through the liquid outlet 505. The reservoir 501 can be made of glass or high temperature plastics, such as PPS, PPA or LCP, PC, etc. In the illustrated embodiment, the reservoir 501 has a substantially tubular shape. In alternative embodiments, the reservoir 501 may have other shapes such as prism.

The reservoir 501 defines an airflow channel 506 therein. The reservoir 501 includes a first end 507 and a second end 508 opposite to the first end 507. The liquid outlet 505 is defined at the second end 508. The airflow channel 506 has a first opening 509 formed at the first end 507 and a second opening 510 formed at the second end 508. Specifically, the liquid outlet 505 is defined on the second end 508, and the liquid outlet 505 has an annular shape surrounding the airflow channel 506. The liquid guiding medium 502 has an annular shape matching the liquid outlet 505, and the liquid guiding medium 502 is received in the liquid outlet. The liquid guiding medium 502 is made of porous liquid guiding materials. In the illustrated embodiment, the liquid guiding medium 502 is made of porous ceramic, preferably porous ceramic material with high thermal conductivity. It should be understood that, in alternative embodiment, the liquid guiding medium 502 can be made of refractory porous glass, porous graphite, porous fibers, and other porous materials.

The heating element 503 includes a reflector 511, a heating tube 512, and an electrode portion 513. The heating tube 512 and the electrode portion 513 are fixed to opposing sides of the reflector 511 respectively, and a gap 500 is formed between the heating tube 512 and the liquid guiding medium 502.

The reflector 511 is shaped as a spherical crown, which can radiate the heat generated by the heating tube 512 towards the liquid guiding medium 502. The reflector 511 is fixed in the cartridge 52. In alternative embodiments, the reflector 511 can have other shapes, as long as it can radiate the heat generated by the heating tube 512 towards the liquid guiding medium 502. One electrode of the electrode portion 513 is electrically coupled to an electrode of the battery 514 of the power assembly 54, and the other electrode of the electrode portion 513 is electrically coupled to the other electrode of the battery 514 of the power assembly 54. In the illustrated embodiment, the reflector 511 can focus the radiation of heat to the liquid guiding medium 502, thereby increasing the usage efficiency of heat.

In the illustrated embodiment, the heating tube 512 is an infrared heating tube. In alternative embodiments, the heating tube 512 can be other heating tubes such as photoelectric heating tube.

Figure 7:
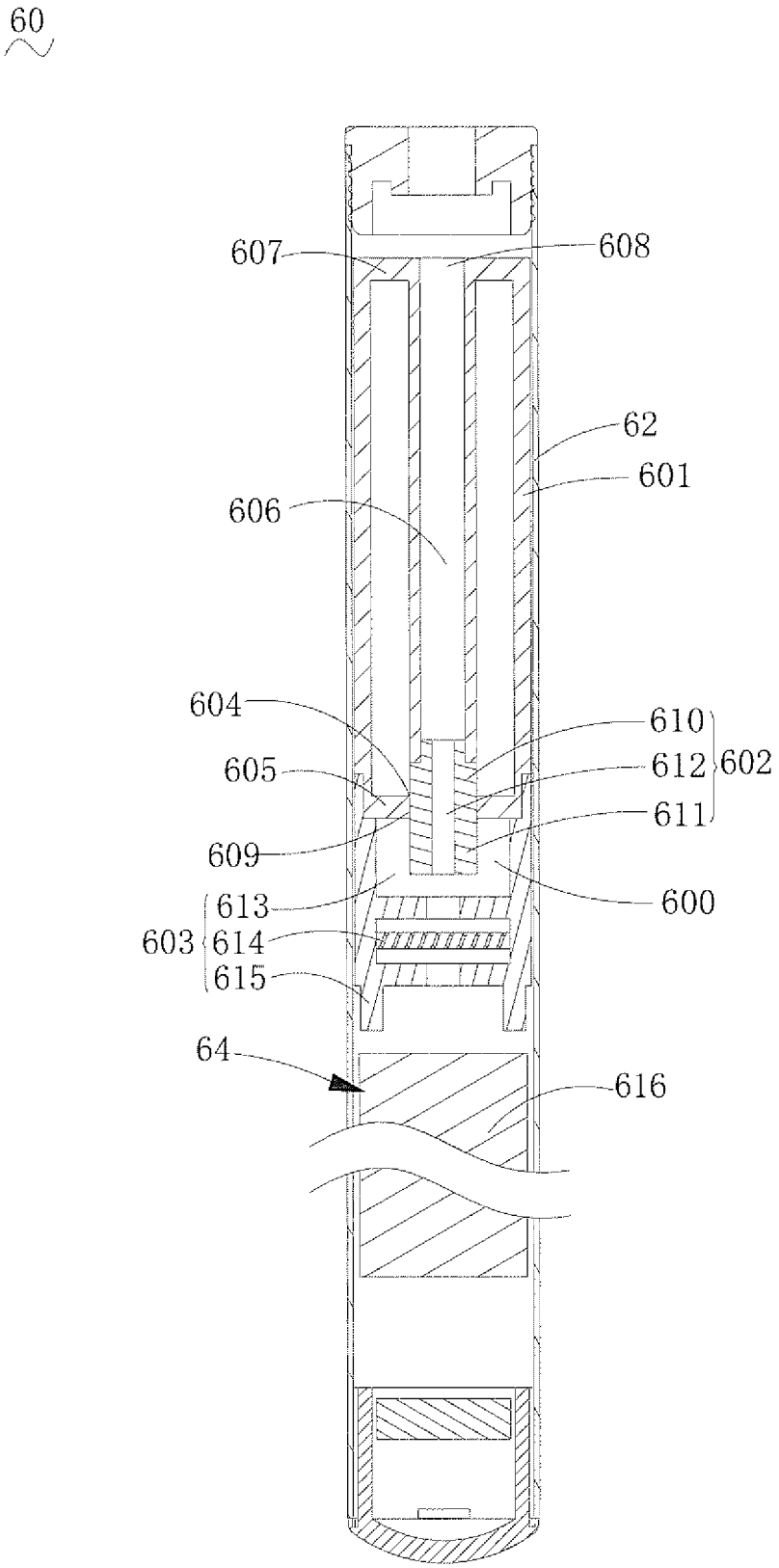
FIG. 7 is a cross-sectional view of an electronic cigarette according to a sixth embodiment.

Referring to FIG. 7, an electronic cigarette 60 is provided according to the sixth embodiment. The electronic cigarette 60 has a structure similar to that of the electronic cigarette 50 of the fifth embodiment, and it differs from electronic cigarette 50 in that, the reservoir 601, the liquid guiding medium 602, and the heating element 603 of the electronic cigarette 60 are different from the fifth embodiment.

In the illustrated embodiment, the liquid outlet 604 of the reservoir 601 is defined at inner surfaces of the second end 605 of the reservoir 601 and the airflow channel 606, i.e. the liquid outlet 604 is located at the junction between the inner surfaces of the second end 605 and the airflow channel 606. The airflow channel 606 has a first opening 608 formed at the first end 607 of the reservoir 601 and a second opening 609 formed at the second end 605.

The liquid guiding medium 602 is made of porous liquid guiding materials and connected to the liquid outlet 604. In the illustrated embodiment, the liquid guiding medium 602 is made of porous ceramic, preferably porous ceramic material with high thermal conductivity. The liquid guiding medium 602 is partially received in the airflow channel 606 via the second opening 609. Specifically, the liquid guiding medium 602 includes an insertion end 610 and a heated end 611 opposing to the insertion end 610. The insertion end 610 is located inside the airflow channel 606, the insertion end 610 has a stepped shape and is connected to the liquid outlet 604, such that the liquid from the reservoir 601 can be guided by the insertion end 610 to the liquid guiding medium 602 through the liquid outlet 604. The liquid guiding medium 602 defines a linear aperture 612 therein, the linear aperture 612 extends through two opposing ends of the liquid guiding medium 602. The linear aperture 612 is in fluid communication with the airflow channel 606. Since the linear aperture 612 is in direct fluid communication with a through hole of the heating element 603 and the airflow channel 606, the airflow can flow more smoothly, and more liquid in the liquid guiding medium 602 will be atomized, thus further improving the atomizing effect and efficiency. It should be understood that, in alternative embodiment, the liquid guiding medium 602 can be made of refractory porous glass, porous graphite, porous fibers, and other porous materials.

The heating element 603 is a microwave heating device. The heating element 603 is fixed inside the cartridge 62 and is connected to the reservoir 601. The heating element 603 has a heating chamber 613, a coil 614, and an electrode portion 615. The heating chamber 613 and the electrode portion 615 are located on opposing sides of the coil 614. The heated end 611 of the liquid guiding medium 602 is received in the heating chamber 613, and a gap 600 is formed between the heated end 611 and the heating element 603. Since the heating element 603 is connected to the reservoir 601, the heating chamber 613 can be well surrounded with less heat loss, and the liquid guiding medium 602 can absorb more heat to improve the efficiency of the electric heat and atomizing effect.

The coil 614 is electrically coupled to the electrode portion 615. One electrode of the electrode portion 615 is electrically coupled to an electrode of the battery 616 of the power assembly 64, and the other electrode of the electrode portion 615 is electrically coupled to the other electrode of the battery 616, such that the power assembly 64 can provide power to the coil 614 via the electrode portion 615 to generate microwave, thus heating the liquid guiding medium 602.

Figure 8:
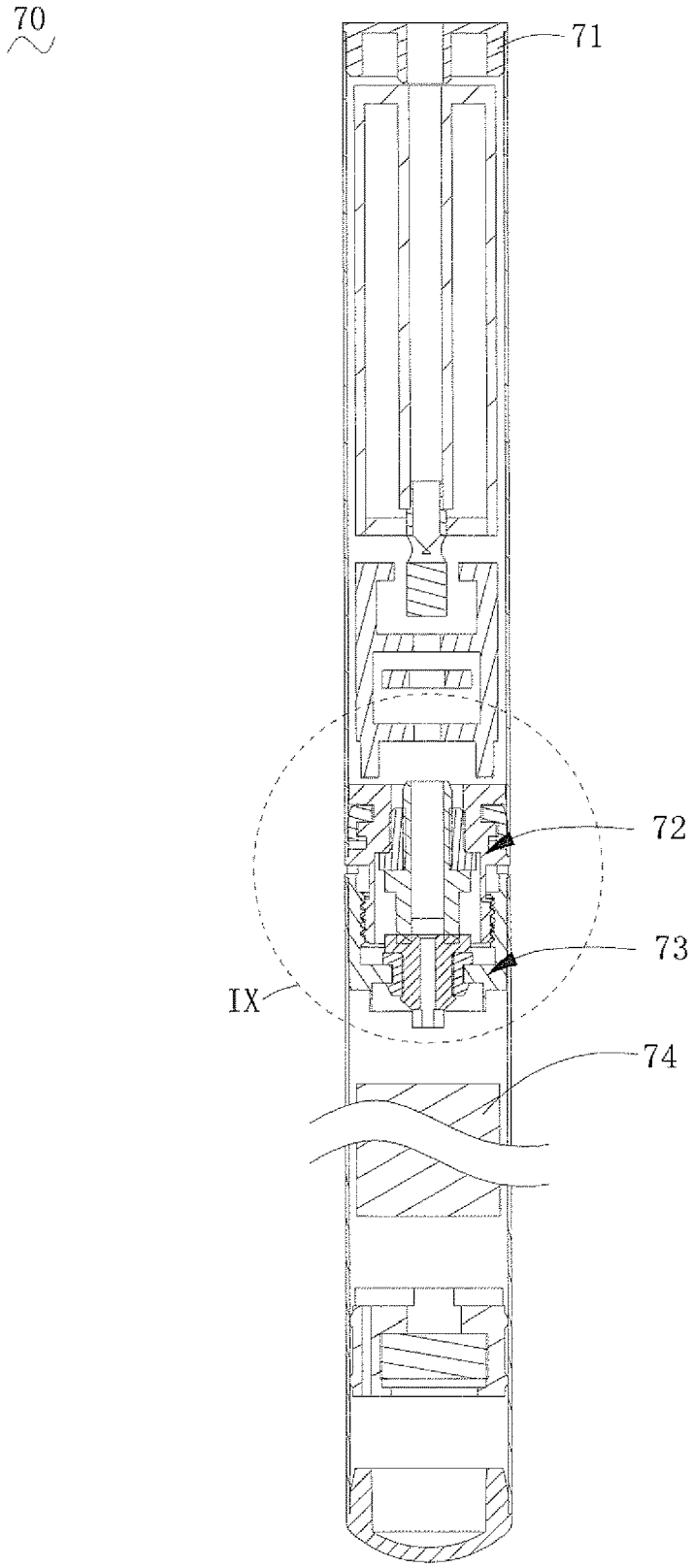
FIG. 8 is a cross-sectional view of an electronic cigarette according to a seventh embodiment.
Figure 9:
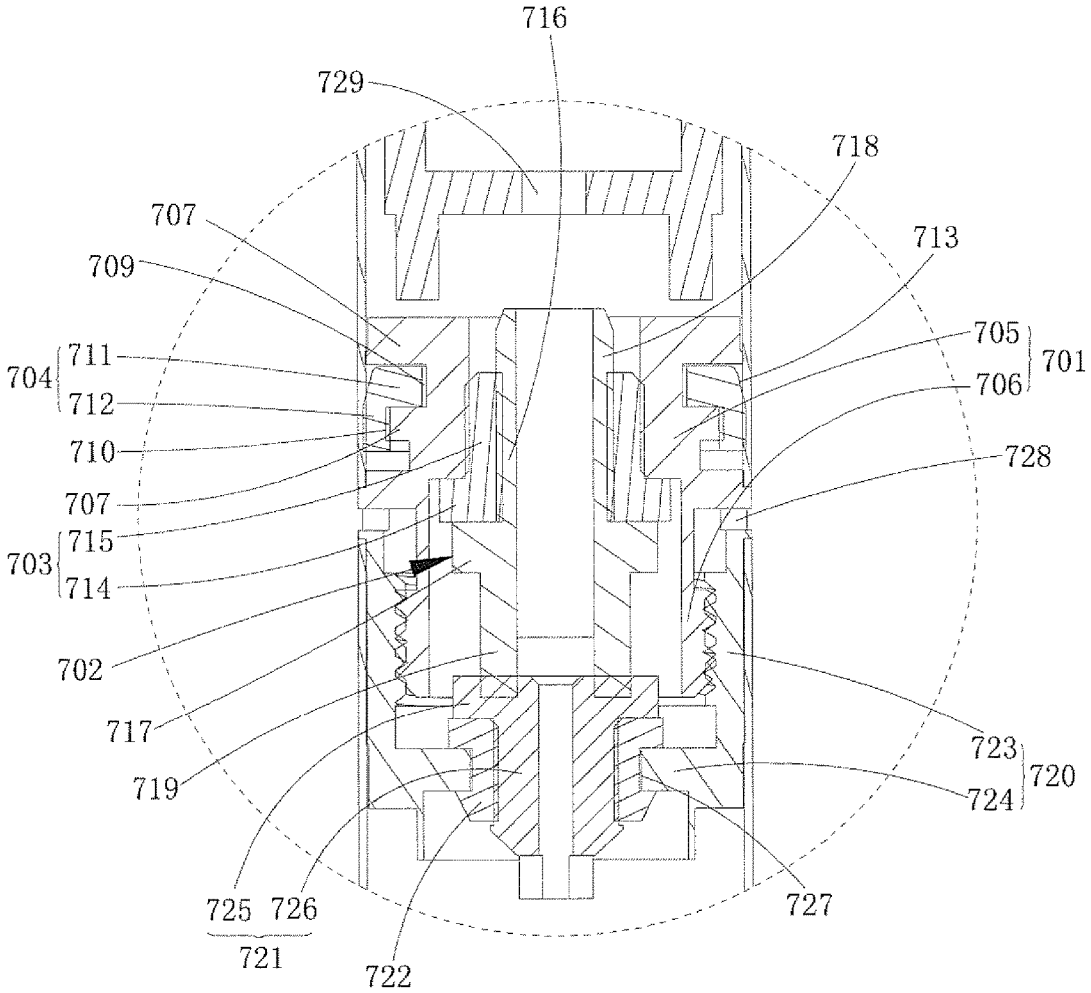
FIG. 9 is an enlarged view of portion IX of the electronic cigarette of FIG. 8.

Referring to FIG. 8 and FIG. 9, an electronic cigarette 70 is provided according to the seventh embodiment. The electronic cigarette 70 has a structure similar to that of the electronic cigarette 10 of the first embodiment, and it differs from electronic cigarette 10 in that, the mouthpiece 71, the first connection structure 72, the second connection structure 73 and the power assembly 74 of the electronic cigarette 70 are different from the first embodiment.

The mouthpiece 71 has a columnar shape. The first connection structure 72 includes a conductive threaded post 701, a first electrode tube 702, a first insulating sleeve 703, and a resilient element 704.

The resilient element 704 is disposed between the threaded post 701 and the cartridge, thus the threaded post 701 and the cartridge are firmly engaged. The first insulating sleeve 703 is disposed between the threaded post 701 and the first electrode tube 702, thus the threaded post 701 and the first electrode tube 702 are insulated from each other and are firmly engaged.

The threaded post 701 is fixed to the second connecting end of the cartridge and is connected to an electrode of the heating element. The threaded post 701 includes a first cylinder 705 and a second cylinder 706 connected to the first cylinder 705. The first cylinder 705 has a maximum outer diameter which is substantially equal to the inner diameter of the cartridge, such that the outer sidewall of the first cylinder 705 is firmly attached to the inner sidewall of the cartridge to form a close engagement. The second cylinder 706 is provided with an external thread on an outer side thereof for coupling the second connection structure 73. The second cylinder 706 has a smaller outer diameter than the inner diameter of the cartridge. The first cylinder 705 and the cartridge are closely engaged via the resilient element 704.

The first cylinder 705 is provided with first and second spaced apart flanges 707, 708. The first flange 707 has a greater outer diameter than that of the second flange 708. A first annular groove 709 is formed between the first flange 707 and the second flange 708. A second annular groove 710 is formed between the second flange 708 and an inner sidewall of the cartridge. The threaded post 701 is conductive. In the illustrated embodiment, the threaded post 701 is made of gold-plated brass. The threaded post of this material has an excellent conductivity, as well as good plasticity for easy shaping. In alternative embodiments, the threaded post 701 can be made of other conductive materials.

The resilient element 704 includes a ring 711 and a bending portion 712 connected to the ring 711. The ring 711 has a circular shape. The bending portion 712 extends perpendicularly from an edge of the ring 711. The ring 711 is received in the first annular groove 709 formed between the first flange 707 and the second flange 708. The ring 711 has an inclined surface 713 on a side thereof adjacent to the cartridge for guiding installation. An angle formed by the inclined surface 713 and the inner surface of the cartridge is ranged from 5° to 30°. A gap for guiding installation is formed between the resilient element 704 and the inner surface of the cartridge due to the angle formed by the inclined surface 713 and the inner surface of the cartridge. In the illustrated embodiment, the ring 711 is embedded in the first annular groove 709 and is in close contact with partial inner sidewall of the cartridge, such that the cartridge forms a close engagement with the threaded post 701. The bending portion 712 is located between the cartridge and the first cylinder 705. During assembly of the resilient element 704, the resilient element 704 will be deformed by pressing, and the deformed partial bending portion 712 is received in the second annular groove 710 formed between the inner sidewall of the cartridge and the second flange 708. The resilient element 704 is made of rubber. Specifically, the resilient element 704 can be made of silicone rubber, fluorine rubber, fluorosilicone rubber.

The first insulating sleeve 703 includes an annular insulating substrate 714 and an insulating tube 715 located on the insulating substrate 714. Partial inner sidewall of the first cylinder 705 is firmly attached to partial outer sidewall of the insulating tube 715 and the insulating substrate 714. The first insulating sleeve 703 is disposed between the threaded post 701 and the first electrode tube 702, thereby insulating the threaded post 701 from the first electrode tube 702, and a close engagement is formed between the threaded post 701 and the first electrode tube 702. A structural stability of the threaded post 701 and the second electrode tube 702 is increased accordingly. The first insulating sleeve 703 can be made of insulation materials, such as silicone, rubber, etc.

The first electrode tube 702 includes a first conductive tube 716 and a ring portion 717 positioned on the first conductive tube 716. The first conductive tube 716 has a first contact end 718 and a second contact end 719, which are located on opposing sides of the ring portion 717. The first contact end 718 is connected to the other electrode of the heating element. The inner sidewall of the first insulating sleeve 703 is attached to partial outer sidewall of the first electrode tube 702. The ring portion 717 has a greater cross-sectional area with respect to the first conductive tube 716, thus a contact area between the ring portion 717 and the first insulating sleeve 703 is increased, thereby improving the stability between the first conductive tube 716 and the first insulating sleeve 703. The threaded post 701 serves as one electrode, while the first conductive tube 716 serves as the other electrode, which is electrically coupled to the power assembly 74 and the heating element of the electronic cigarette 70. In the illustrated embodiment, the first conductive tube 716 is made of the same material as that of the threaded post 701, i.e. gold-plated brass. In alternative embodiments, the first conductive tube 716 can be made of other metal materials.

The second connection structure 73 includes a conductive threaded sleeve 720, a second electrode tube 721, and an insulating sleeve 722.

The threaded sleeve 720 is fixed to the power assembly 74 and is connected to one electrode of the power assembly 74. The threaded sleeve 720 includes a threaded portion 723 and a rim portion 724 connected to the threaded portion 723. The threaded portion 723 has an internal thread, which can be engaged with the external thread of the second cylinder 706, so as to connect the threaded portion 723 to the second cylinder 706, such that the threaded post 701 is engaged with the threaded sleeve 720 to achieve the electrical connection. The threaded sleeve 720 is made of gold-plated brass, which has a good conductivity with excellent plasticity for easy shaping. In alternative embodiment, the threaded sleeve 720 can be made of other conductive materials.

The second electrode tube 721 is connected to the other electrode of the power assembly 74. The second electrode tube 721 is received in the threaded sleeve 720 and is connected to the second contact end 719 to form an electrical connection with the first electrode tube 716. Specifically, the second electrode tube 721 includes an annular-shaped base 725 and a second conductive tube 726 connected to the base 725. The second conductive tube 726 extends through the second insulating sleeve 722. The base 725 has a greater cross-sectional area with respect to the second conductive tube 726, thus a contact area between the base 725 and the second insulating sleeve 722 is increased, thereby improving the stability between the second electrode tube 721 and the second insulating sleeve 722. In the illustrated embodiment, the second electrode tube 721 is made of the same material as that of the threaded sleeve 720, i.e. gold-plated brass. In alternative embodiments, the second electrode tube 721 can be made of other metal materials.

The second insulating sleeve 722 is located between the rim portion 724 and the second electrode tube 721, thus insulating the threaded sleeve 720 from the second electrode tube 721. The second insulating sleeve 722 defines a latching groove 727 on an outer peripheral thereof. The rim of the rim portion 724 is firmly engaged in the latching groove 727, thereby further improving the binding stability between the second electrode tube 721 and the threaded sleeve 720.

In the illustrated embodiment, an air intake 728 is formed between the threaded sleeve 720 and the first cylinder 705, and the first connection structure 72 further defines a gas hole (not shown, e.g. the one radially extends through the second cylinder 706 and the first electrode tube 716) in fluid communication with the air intake 728. The gas hole is in fluid communication with a through hole 729 of the heating element.

In the illustrated embodiment, since the ring 711 of the resilient element 704 is received in the annular groove 709 of the threaded post 701, and the bending portion 712 extends perpendicularly from an edge of the ring 711 and is clamped between the threaded post 701 and the cartridge, the resilient element 704 can be firmly attached to partial sidewall of the threaded post 701. Therefore the contact area between the resilient element 704 and the threaded post 701 is increased to the largest extent, and a more firmly pressure is provided, such that the threaded post 701 is more firmly connected to the cartridge.

Because the switch is omitted in the power assembly 74, the electronic cigarette 70 has a simple structure and a lower cost. In addition, the electronic cigarette 70 further includes an airflow sensor assembly (not shown), which can control on and off of the electrical connection between the heating element and the power assembly 74. When the user inhales at the mouthpiece, the external airflow can enter the electronic cigarette 70 through the air intake 728. The airflow sensor assembly can sense the size of the airflow and control the heating element to work or stop working. The airflow sensor can render different atomizing effect according to the different intensity of respiration of the user, thus increasing the user's experiences.

Figure 10:
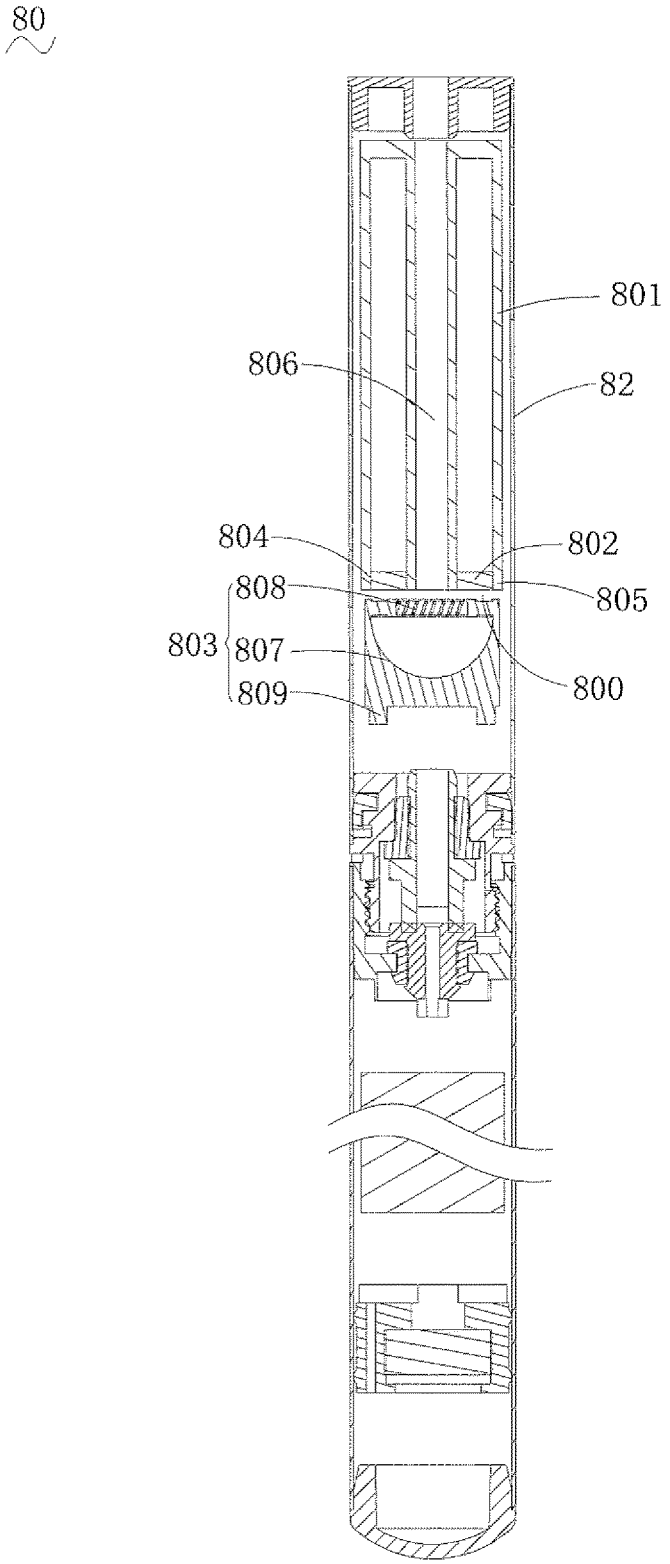
FIG. 10 is a cross-sectional view of an electronic cigarette according to a eighth embodiment.

Referring to FIG. 10, an electronic cigarette 80 is provided according to the eighth embodiment. The electronic cigarette 80 has a structure similar to that of the electronic cigarette 70 of the seventh embodiment, and it differs from electronic cigarette 70 in that, the reservoir 801, the liquid guiding medium 802, and the heating element 803 of the electronic cigarette 80 according to the eighth embodiment are different from the seventh embodiment.

The liquid outlet 804 of the reservoir 801 is defined on the second end 805 of the reservoir 801, and the liquid outlet 804 has an annular shape surrounding the airflow channel 806. The liquid guiding medium 802 has an annular shape matching the liquid outlet, and the liquid guiding medium 802 is received in the liquid outlet 205.

The heating element 803 includes a reflector 807, a heating tube 808, and an electrode portion 809. The heating tube 808 and the electrode portion 809 are fixed to opposing sides of the reflector 807, and a gap 800 is formed between the heating tube 808 and the liquid guiding medium 802.

The reflector 807 is shaped as a spherical crown, which can radiate the heat generated by the heating tube 808 towards the liquid guiding medium 802. The reflector 807 is fixed to an inner sidewall of the cartridge 82 by, for example, a spaced arranged fixing element or a fixing rod (not shown). The airflow can flow from the gap between the reflector 807 and the cartridge 82 into the gap 800 between the heating tube 808 and the liquid guiding medium 802, such that the atomized liquid can be brought into the airflow channel 806 via the airflow. In alternative embodiments, the reflector 807 can have other shapes, as long as it can radiate the heat generated by the heating tube 808 towards the liquid guiding medium 802. In the illustrated embodiment, since the reflector 807 can focus the heat to the liquid guiding medium 802, the utilization of heat is improved.

In the illustrated embodiment, the heating tube 808 is an infrared heating tube. In alternative embodiments, the heating tube 808 can be a photoelectric heating tube and other heating tube.

Figure 11:
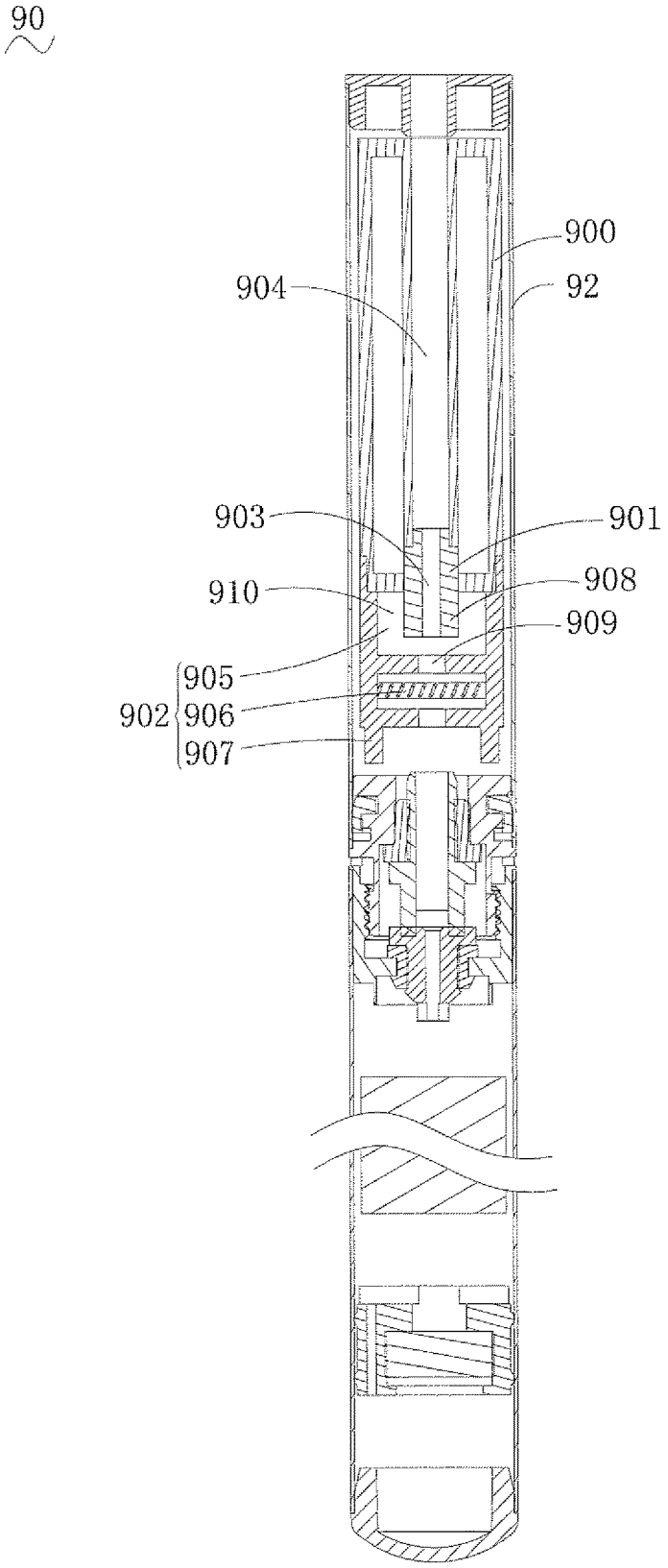
FIG. 11 is a cross-sectional view of an electronic cigarette according to a ninth embodiment.

Referring to FIG. 11, an electronic cigarette 90 is provided according to the ninth embodiment. The electronic cigarette 90 has a structure similar to that of the electronic cigarette 70 of the seventh embodiment, and it differs from electronic cigarette 70 in that, the liquid guiding medium 901 and the heating element 803 of the electronic cigarette 90 according to the ninth embodiment are different from the seventh embodiment.

The liquid guiding medium 901 defines a linear aperture 903 therein, the linear aperture 903 extends through two opposing ends of the liquid guiding medium 901. The linear aperture 903 is in fluid communication with the airflow channel 904.

The heating element 902 is a microwave heating device. The heating element 902 is fixed inside the cartridge 92 and is connected to the reservoir 900. The heating element 902 has a heating chamber 905, a coil 906, and an electrode portion 907. The heating chamber 905 and the electrode portion 907 are located on opposing sides of the coil 906. The heated end 908 of the liquid guiding medium 901 is received in the heating chamber 905, and a gap 910 is formed between the heated end 908 and the heating element 902. Since the heating element 902 is connected to the reservoir 900, the heating chamber 905 can be well surrounded with less heat loss, and the liquid guiding medium 901 can absorb more heat to improve the efficiency of the electric heat and atomizing effect.

The electrode portion 907 is electrically coupled to the first connection structure, for example, one electrode of the electrode portion 907 is connected to the conductive post, and the other electrode of the electrode portion 907 is connected to first conductive tube.

The heating element 902 defines a through hole 909 therein for allowing the air to flow. The linear aperture 903 is in direct fluid communication with the through hole 909 and the airflow channel 904, such that the airflow can flow more smoothly, and more liquid in the liquid guiding medium 901 will be atomized, thus further improving the atomizing effect and efficiency.

Although the description is illustrated and described herein with reference to certain embodiments, the description is not intended to be limited to the details shown. Modifications may be made in the details within the scope and range equivalents of the claims.

What is claimed is:

1. An electronic cigarette, comprising:

a cartridge; and an atomizing assembly fixed in the cartridge, the atomizing assembly comprising:

a reservoir, the reservoir having a liquid storage chamber for storing liquid and a liquid outlet in fluid communication with the liquid storage chamber;

an airflow channel formed within the reservoir, wherein the liquid outlet having an annular shape formed around at an end of the airflow channel;

a liquid guiding medium made of porous liquid guiding material, the liquid guiding medium being of an annular shaped and fitted within the liquid outlet;

a heating element fixed in the cartridge adjacent to the liquid guiding member; and a gap formed between the heating element and the liquid guiding medium, the gap separating the heating element from the liquid guiding medium so the heating element is unconnected from the liquid guiding medium;

wherein the heating element radiates heat through the gap and towards the liquid guiding medium.

2. The electronic cigarette according to claim 1, wherein the liquid reservoir has a tubular shape and defines the airflow channel, the liquid reservoir comprises opposed first and second ends, the liquid outlet is defined at the second end, the airflow channel has a first opening formed at the first end and a second opening formed at the second end.

3. The electronic cigarette according to claim 1, wherein the heating element comprises:

a heating tube positioned below the gap; and a reflector affixed to the heating tube.

4. The electronic cigarette according to claim 3, wherein the reflector is shaped as a spherical crown radiating heat generated by the heating tube towards the liquid guide medium.

5. The electronic cigarette according to claim 3, wherein the reflector shaped as a spherical crown radiating heat generated by the heating tube towards the liquid guide medium, the reflector fixed within the cartridge.

6. The electronic cigarette according to claim 3, wherein the heating element comprises a pair of electrodes, the pair of electrodes fixed to a side of the reflector opposite of the heating tube.

7. The electronic cigarette according to claim 3, wherein the heating tube is an infrared heating tube.

* * * * *